US007802997B2

(12) United States Patent
Kuo

(10) Patent No.: US 7,802,997 B2
(45) Date of Patent: Sep. 28, 2010

(54) STRUCTURE FOR USB BLUETOOTH WIRELESS CONNECTORS

(75) Inventor: Ting-Hung Kuo, Taipei (TW)

(73) Assignee: Vencer Co., Ltd., Taipei (TW)

( * ) Notice: Subject to any disclaimer, the term of this patent is extended or adjusted under 35 U.S.C. 154(b) by 0 days.

(21) Appl. No.: 12/320,382

(22) Filed: Jan. 26, 2009

(65) Prior Publication Data

US 2010/0015853 A1 Jan. 21, 2010

(30) Foreign Application Priority Data

Jul. 18, 2008 (TW) ..... 97212820 U

(51) Int. Cl.
*H01R 12/00* (2006.01)

(52) U.S. Cl. ..... 439/76.1; 361/737

(58) Field of Classification Search ..... 439/76.1, 439/620.21, 620.22, 607.55; 361/736, 737, 361/752

See application file for complete search history.

(56) References Cited

U.S. PATENT DOCUMENTS 6,422,469 B1 * 7/2002 Pernet ..... 235/486
6,676,419 B1 * 1/2004 Lin et al. ..... 439/76.1
6,994,568 B2 * 2/2006 Huang et al. ..... 439/76.1
6,999,322 B1 * 2/2006 Lin ..... 361/752
7,035,110 B1 * 4/2006 Wang et al. ..... 361/737
7,052,287 B1 * 5/2006 Ni et al. ..... 439/76.1
7,172,460 B2 * 2/2007 Zhao et al. ..... 439/607.56
7,259,967 B2 * 8/2007 Ni ..... 361/760
7,359,208 B2 * 4/2008 Ni ..... 361/752
7,394,661 B2 * 7/2008 Wang et al. ..... 361/737
7,407,390 B1 * 8/2008 Ni ..... 439/76.1
7,442,051 B2 * 10/2008 Jiang et al. ..... 439/76.1
7,524,198 B2 * 4/2009 Nguyen et al. ..... 439/131

* cited by examiner

*Primary Examiner*—T C Patel
*Assistant Examiner*—Harshad C Patel
(74) *Attorney, Agent, or Firm*—Bacon & Thomas, PLLC

(57) ABSTRACT

An improved structure for a USB bluetooth wireless connector includes a circuit board, a body, and a housing. The circuit board includes a top surface and a bottom surface. The body includes an upper board and a lower bracket, and that the circuit board is interposed between the upper board and the lower bracket. The housing includes a top surface, a bottom surface, and two side surfaces. The body is provided with at least one anchoring hole; and the housing is provided with at least one engaging portion for engaging and securing together the body and the housing. A plurality of connecting terminals are integrally arranged on the circuit board so as to greatly reduce volume of the USB bluetooth wireless device and to lower the possibility of damage on the device or USB receptacle due to impact thereon.

4 Claims, 4 Drawing Sheets

STRUCTURE FOR USB BLUETOOTH WIRELESS CONNECTORS

BACKGROUND OF THE INVENTION

1. Field of the Invention

The present invention relates to an improved structure for a bluetooth wireless connector, more particularly, to an improved structure for a bluetooth wireless connector adapted for USB transmission interface.

2. Description of Related Art

Universal Serial Bus (USB) transmission interface has merits in hot plug, plug and play, high transmission speed, high portability, and so forth. Therefore, it has become a basic interface for various peripheral electronic devices, such as keyboards, mice, printers, scanners, external storage devices, and digital cameras. Currently, bluetooth wireless devices available in the market also require a USB plug to connect a bluetooth module to a computer. Referring to FIG. 1, a perspective view illustrating a conventional USB bluetooth wireless device, and to FIG. 2, a cross-sectional view illustrating the conventional USB bluetooth wireless device, the USB bluetooth wireless device 10 comprises a USB plug 11 and a bluetooth module 12, wherein the bluetooth module 12 includes a covering shell 121 and a circuit board 122 packaged by the covering shell 121, and the USB plug 11 includes a covering shell 111 and a carrying board 112 enclosed by the covering shell 111. There are power source lines 113 arrayed on the carrying board 112, and that the power source lines 113 are electrically connected with the circuit board 122. When the USB bluetooth wireless device 10 is plugged into the USB receptacle of a computer, the bluetooth module 12 and the computer can then be communicated with each other. However, the USB bluetooth wireless device 10, formed with the above-mentioned structure, has a disadvantage of being bulky, so that the USB bluetooth wireless device 10 or the USB receptacle may be damaged due to an impact thereon. As such, an improvement made on the structure of the conventional art has become an urge.

SUMMARY OF THE INVENTION

The present invention is to provide an improved structure for a USB bluetooth wireless connector, comprising a circuit board, a body, and a housing.

The circuit board includes a top surface and a bottom surface, wherein the top surface is fixedly provided with a plurality of connecting terminals, and the bottom surface with at least one electronic component. The body includes an upper board and a lower bracket, wherein a stop portion is formed between the upper board and the lower bracket, and the circuit board is interposed between the upper board and the lower bracket. A rear edge of the circuit board is correspondingly stopped at the stop portion. The housing includes a top surface, a bottom surface, and two side surfaces, which surround together and define an inner chamber having a front opening and a rear opening.

The body is, at the upper board, provided with at least one anchoring hole; and the housing, at the top surface corresponding to the at least one anchoring hole, is provided with at least one engaging portion, preferably a one-way engaging portion, for engaging and securing together the body and the housing. The housing is, at a front end of each side surface, provided inward with a protrusion for engaging and securing the circuit board. Further, the body includes a front lateral rod located at a front edge of the bottom surface of the circuit board so as to protect the at least one electronic component at the bottom surface.

According to the present invention, the body may be made of insulating material, or equivalents; and that the housing of metallic material, or equivalents.

Other objects, advantages, and novel features of the present invention will become more apparent from the following detailed description when taken in conjunction with the accompanying drawings.

DETAILED DESCRIPTION OF THE PREFERRED EMBODIMENTS

The following embodiments are given description directing to an improved structure for a USB bluetooth wireless connector, so that technical contents of the present invention may be comprehended.

Figure 1:
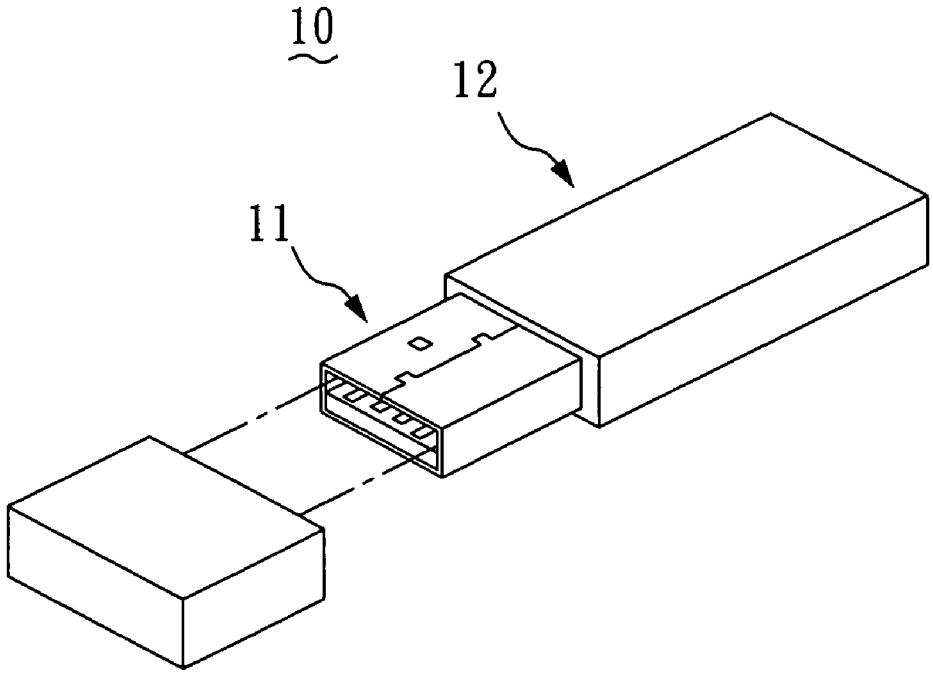
FIG. 1 (PRIOR ART)
FIG. 1 is a perspective view illustrating a conventional USB bluetooth wireless device.
Figure 2:
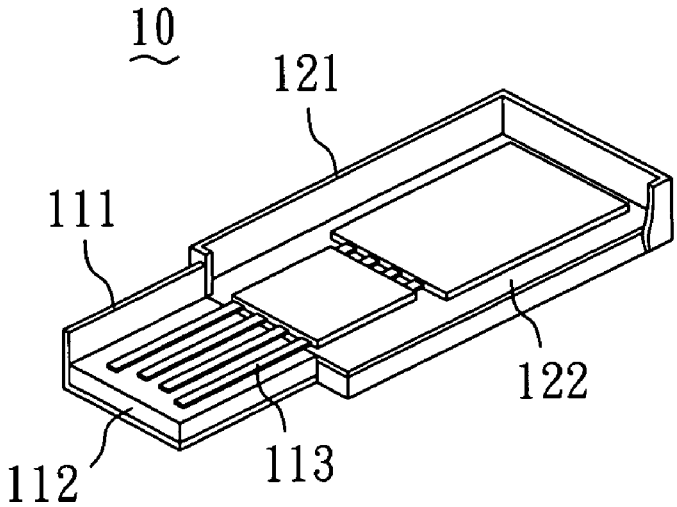
FIG. 2 (PRIOR ART)
FIG. 2 is a cross-sectional view illustrating the conventional USB bluetooth wireless device.
Figure 3:
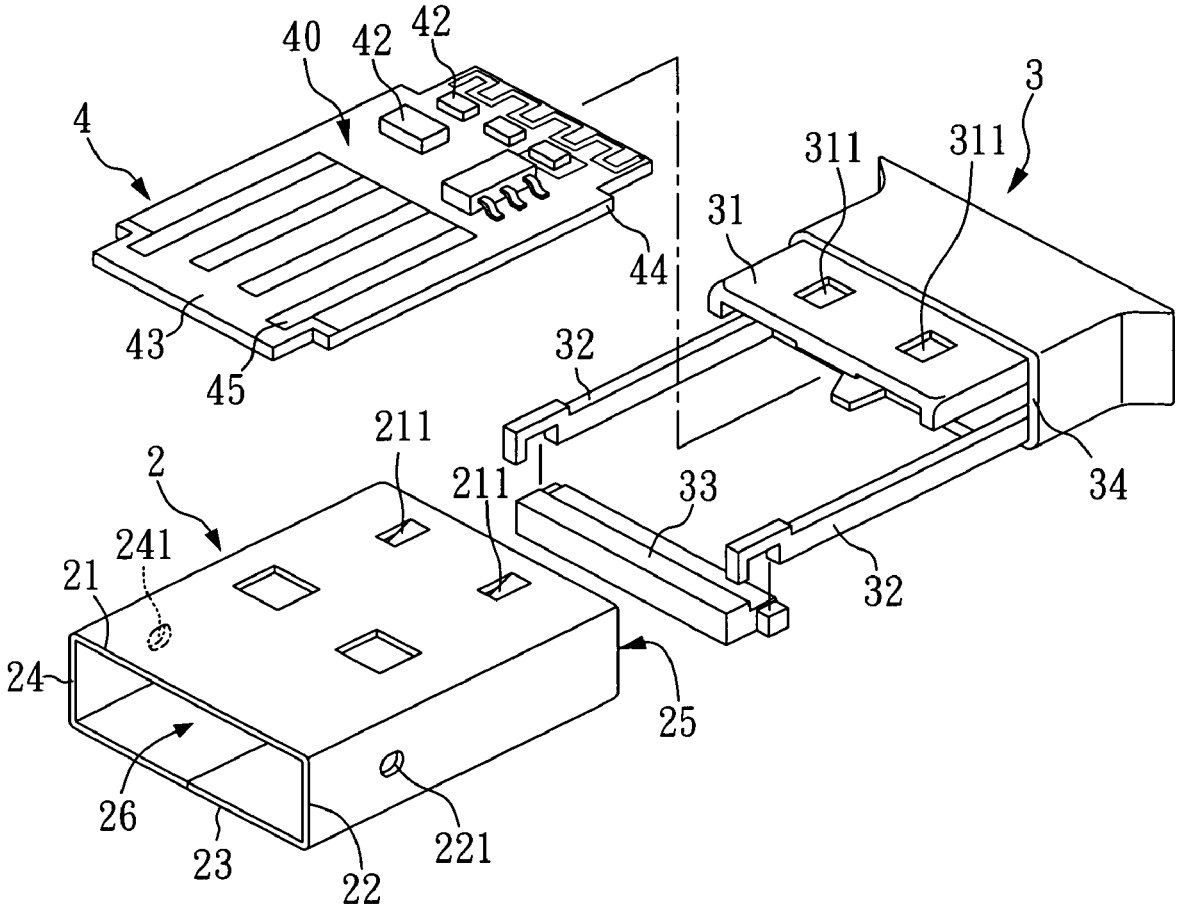
FIG. 3 is an exploded view illustrating an improved structure for a USB bluetooth wireless connector according to a first embodiment of the present invention.
Figure 4:
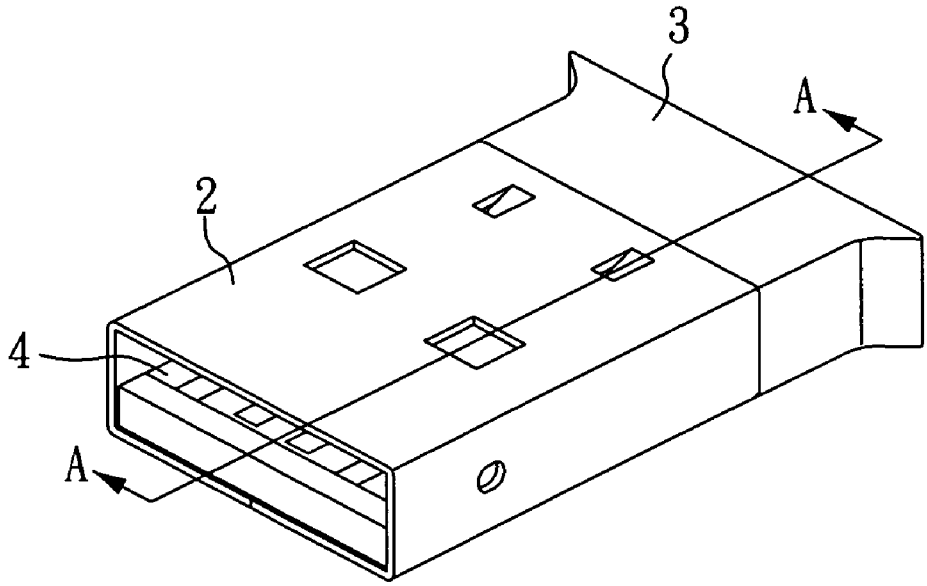
FIG. 4 is a perspective view illustrating the improved structure for a USB bluetooth wireless connector according to the first embodiment of the present invention.

Now referring to FIG. 3, an exploded view illustrating an improved structure for a USB bluetooth wireless connector according to a first embodiment of the present invention, and to FIG. 4, a perspective view illustrating the improved structure for a USB bluetooth wireless connector according to the first embodiment of the present invention, the improved structure comprises a circuit board 4, a body 3, and a housing 2.

Figure 5:
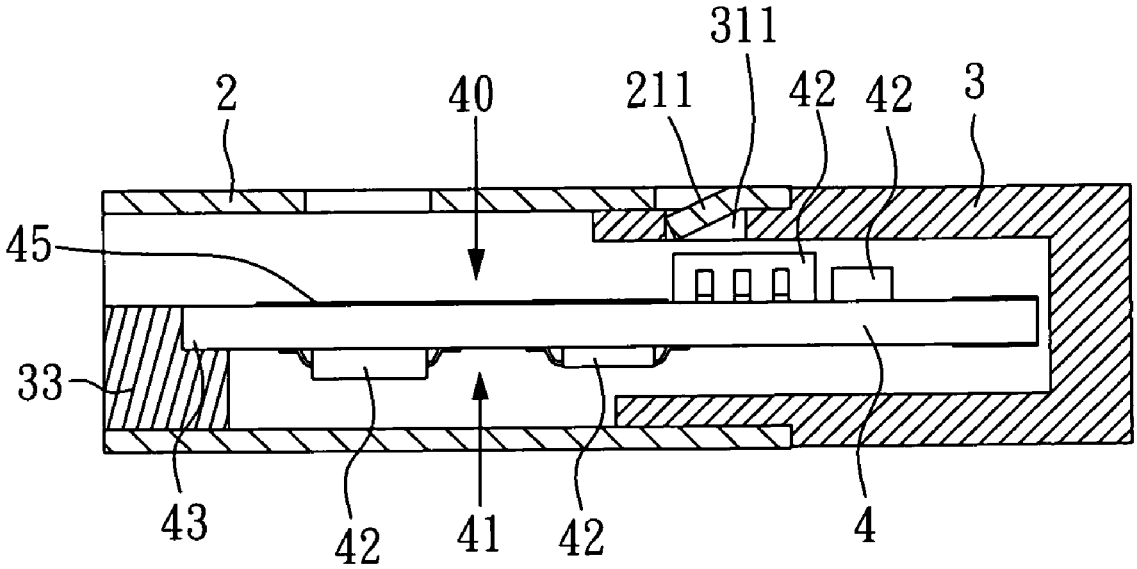
FIG. 5 is a cross-sectional view taken along cutting line A-A of FIG. 4.

Reference may also made to FIG. 5, a cross-sectional view taken along cutting line A-A of FIG. 4, the circuit board 4 includes a top surface 40 and a bottom surface 41, wherein the top surface 40 is fixedly provided with a plurality of connecting terminals 45 and of electronic components 42, whereas the bottom surface 41 is fixedly provided with a plurality of electronic components 42. The body 3 includes an upper board 31 and a lower bracket 32, wherein a stop portion 34 is formed between the upper board 31 and the lower bracket 32. The circuit board 4 is interposed between the upper board 31 and the lower bracket 32, and that a rear edge 44 of the circuit board 4 is correspondingly stopped at the stop portion 34. The housing 2 includes a top surface 21, a bottom surface 23, a left surface 24, and a right surface 22, which surround together and define an inner chamber having a front opening 26 and a rear opening 25. In the present embodiment, preferably, the body 3 is made of insulating material, or equivalents; and that the housing 2 of metallic material, or equivalents.

Further, the body 3 is, at the upper board 31, provided with two anchoring holes 311; whereas the housing 2, at the top surface 21 corresponding to the two anchoring holes 311, is provided with two engaging portions 211, preferably two one-way engaging portions, for engaging and securing together the body 3 and the housing 2, such that the body 3 and the housing 2, after assembly, will not slide back and forth against each other. The housing 2 is, at a front end of the left surface 24 and of the right surface 22 provided inward protrusions 241,221 for engaging and securing the circuit board 4, such that sliding upward and downward of the circuit board 4 in the housing 2 can thus be avoided. Still further, as shown in FIG. 5, the body 3 includes a front lateral rod 33 located at a front edge 43 of the bottom surface 41 of the circuit board 4 so as to partly block the front opening 26 between a front end of the circuit board 4 and a bottom of the housing 2, such that the electronic components 42 located at the bottom surface 41 of the circuit board 4 can be protected.

In the present embodiment, the connecting terminals 45 are integrally arranged on the circuit board 4, where the circuit board 4 takes the place of the carrying board 112 of the conventional USB bluetooth wireless device 10 so as to greatly reduce the volume thereof and to lower the possibility of damage on the USB bluetooth wireless device 10 or the USB receptacle due to impact thereon.

Figure 6:
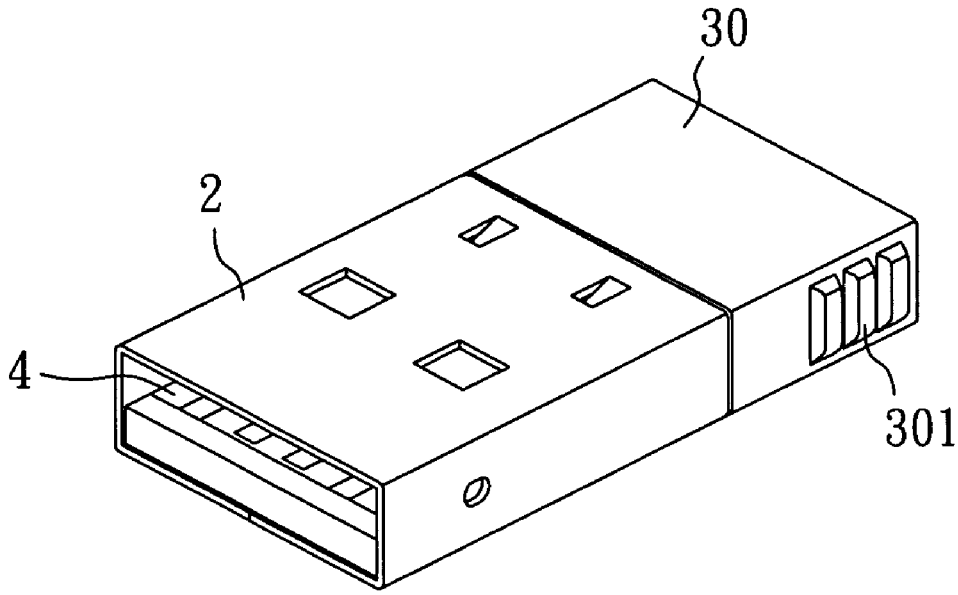
FIG. 6 is a perspective view illustrating an improved structure for a USB bluetooth wireless connector according to a second embodiment of the present invention.
Figure 7:
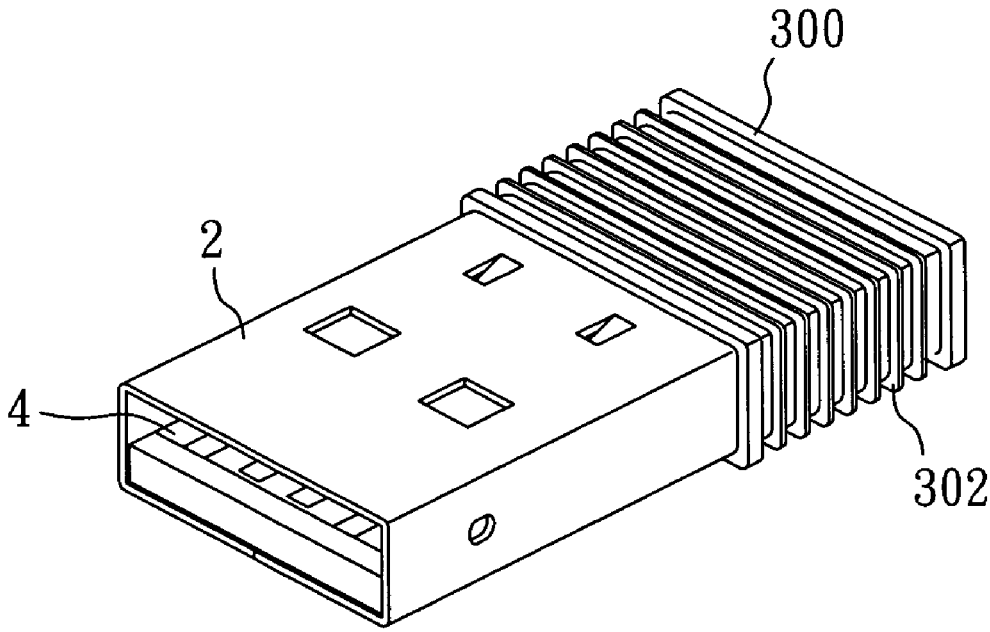
FIG. 7 is a perspective view illustrating an improved structure for a USB bluetooth wireless connector according to a third embodiment of the present invention.

According to the present invention, no intention is given to limit configuration of the body 3, but instead the configuration of the body 3 can be modified in consideration of commercial requirements. Referring to FIG. 6, a perspective view illustrating an improved structure for a bluetooth wireless connector according to a second embodiment of the present invention, the second embodiment is similar in structure to the first embodiment except for a difference on the configuration of a body 30. In the second embodiment, the body 30 is provided, at right side and left side respectively, with three non-slipping blocks 301, in an attempt to increase friction for grabbing when a user is plugging or unplugging the USB bluetooth wireless connector. Further, referring to FIG. 7, a perspective view illustrating an improved structure for a USB bluetooth wireless connector according to a third embodiment of the present invention, the third embodiment is similar in structure to the second embodiment except for a difference on the configuration of the body 30. In the third embodiment, a body 300 is provided, surroundingly, with a plurality of non-slipping flanges 302 so as to increase friction for plugging or unplugging the USB bluetooth wireless connector.

Although the present invention has been explained in relation to its preferred embodiments, it is to be understood that many other possible modifications and variations can be made without departing from the scope of the invention as hereinafter claimed.

What is claimed is:

1. An improved structure for a USB bluetooth wireless connector, comprising:

a circuit board, including a top surface and a bottom surface, wherein the top surface is fixedly provided with a plurality of connecting terminals, and the bottom surface with at least one electronic component;

a body, including an upper board and a lower bracket, wherein a stop portion is formed between the upper board and the lower bracket, and the circuit board is interposed between the upper board and the lower bracket, and wherein a rear edge of the circuit board is correspondingly stopped at the stop portion;

a housing, including a top surface, a bottom surface, and two side surfaces, which surround together and define an inner chamber having a front opening and a rear opening;

whereby, the body is, at the upper board, provided with at least one anchoring hole, and the housing, at the top surface corresponding to the at least one anchoring hole, is provided with at least one engaging portion for engaging and securing together the body and the housing;

wherein the housing is provided, at a front end of each side surface, with an inward protrusion for engaging and securing the circuit board; and wherein the body further includes a front lateral rod located at a front edge of the bottom surface of the circuit board so as to protect the at least one electronic component at the bottom surface.

2. The improved structure for a USB bluetooth wireless connector as claimed in claim 1, wherein the engaging portion is a one-way engaging portion.

3. The improved structure for a USB bluetooth wireless connector as claimed in claim 1, wherein the body is made of insulating material.

4. The improved structure for a USB bluetooth wireless connector as claimed in claim 1, wherein the housing is made of metallic material.

* * * * *